United States Patent [19]

Inukai et al.

[11] Patent Number: 4,827,176

[45] Date of Patent: May 2, 1989

[54] METAL VAPOR DISCHARGE LAMP WITH RADIOACTIVELY IMPREGNATED CERAMIC MATERIAL BODY

[75] Inventors: Shinji Inukai, Yokohama; Kazuo Honda, Zushi; Akihiro Kamiya, Yokohama, all of Japan

[73] Assignee: Kabushiki Kaisha Toshiba, Kawasaki, Japan

[21] Appl. No.: 135,077

[22] Filed: Dec. 18, 1987

[30] Foreign Application Priority Data

Dec. 22, 1986 [JP] Japan ..... 61-303978

[51] Int. Cl.[4] ..... H01J 61/18; H01J 17/32; H01J 65/08

[52] U.S. Cl. ..... 313/54; 501/155; 313/638

[58] Field of Search ..... 313/54; 501/155; 252/629; 343/638

[56] References Cited

U.S. PATENT DOCUMENTS

| | | | |
|---|---|---|---|
| 3,093,593 | 6/1963 | Arrance | 252/629 |
| 4,445,067 | 4/1984 | Inoue et al. | 313/54 |
| 4,568,856 | 2/1986 | Inoue et al. | 313/54 X |

FOREIGN PATENT DOCUMENTS

| | | | |
|---|---|---|---|
| 0090463 | 7/1980 | Japan | 501/155 |

*Primary Examiner*—Palmer C. DeMeo
*Attorney, Agent, or Firm*—Oblon, Fisher, Spivak, McClelland & Maier

[57] ABSTRACT

A metal vapor discharge lamp. The metal vapor discharge lamp includes an enclosed discharge tube having a pair of main electrodes mounted at spaced apart locations therein, the discharge tube including a fill of at least a metal vapor and a starting gas, a radiation source including radioactively impregnated ceramic material having a vitrified radioactive outer protection portion and an outer bulb for enclosing the discharge tube and a circuit for electrically generating an arc between the main electrodes.

15 Claims, 1 Drawing Sheet

METAL VAPOR DISCHARGE LAMP WITH RADIOACTIVELY IMPREGNATED CERAMIC MATERIAL BODY

FIELD OF THE INVENTION

The present invention relates generally to a metal vapor discharge lamp, and more particularly, to a metal vapor discharge lamp having a radioactive discharge starting element.

BACKGROUND OF THE INVENTION

In general, a metal vapor discharge lamp, such as a metal halide lamp or a high pressure sodium lamp, has the advantage of an excellent luminous efficacy. However, such a metal vapor discharge lamp requires a high voltage to start its operation.

In recent years, a metal vapor discharge lamp which has compatibility with a high pressure mercury vapor lamp has been developed. The compatible metal vapor discharge lamp is started using a stabilizer for mercury vapor discharge lamps. With such a metal vapor discharge lamp, however, it is necessary to lower the starting voltage sufficiently near the starting voltage of high pressure mercury vapor lamps.

An example of a technique for reducing the starting voltage is disclosed in the Japanese Patent, Sho. 60-34220 which is owned by the same applicant. The Japanese Patent discloses a metal vapor discharge lamp which contains a radiation source including radioactive material with a half-life of 0.5 to 10 years for reducing the starting voltage. In the metal vapor discharge lamp, the radiation source usually emits rays. The rays ionize metal vapor in the metal vapor discharge lamp so that electrons are generated in the metal vapor discharge lamp. The electrons resulting from the ionization may cause an initial discharge in the lamp at the starting of the metal vapor discharge lamp. Thus, the rays emitted from the radiation source operate as a seed for the initial discharge.

However, such radiation sources are likely to exert adverse influence on the human body. Therefore, careful attention must be payed to handling the radiation sources during manufacture of such a metal vapor discharge lamp containing the radiation sources.

Another example of atechnique for reducing the starting voltage is disclosed in U.S. Pat. No. 4,445,067, which is assigned to the same applicant and corresponds to Japanese Patent, Sho. 60-34222. U.S. Pat. No. 4,445,067 also discloses a metal vapor discharge lamp which contains a radiation source. The radiation source is comprised of a radioactive material and a ceramic container made of ceramic material. The radioactive material is dispersed in the ceramic container. In the metal vapor discharge lamp, the radiation source further has a production shell for sealing the ceramic container. The protection shell is made of non-radioactive, heat-resistant and corrosion-resistant material, for example, glass.

However, the metal vapor discharge lamp described in U.S. Pat. No. 4,445,067 had drawbacks as follows. For example, the radiation source requires a process for sealing the ceramic container by glass during manufacture of the radiation source. The protection shell is apt to vary in thickness. Thus, there is a risk of failure of the shell, depending on the thickness. When the protection shell, such as a glass shell, is made thicker to increase its safety, the protection shell interferes with the transmission of the rays emitted from the radioactive material therethrough. As a result, the benefit of the radiation source for the rapid starting of the metal vapor discharge lamp which is the inherent object of the radiation source, decreases.

SUMMARY OF THE INVENTION

Accordingly one object of the present invention is to increase the level of radiation for starting a metal vapor discharge lamp.

Another object of the present invention is to provide a novel metal vapor discharge lamp exhibiting improved starting characteristics.

Yet another object of the present invention is to provide a novel metal vapor discharge lamp exhibiting high safety in spite of increased radiation.

These and other objects have now been achieved according to the present invention by providing a novel metal vapor discharge lamp which includes an enclosed discharge tube having a pair of main electrodes mounted at spaced apart locations therein, the discharge tube including a fill of at least a metal vapor and a starting gas, a radiation source including radioactively impregnated ceramic material having a vitrified radioactive outer protection portion and an outer bulb for enclosing the discharge tube and a circuit for electrically generating an arc between the main electrodes.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
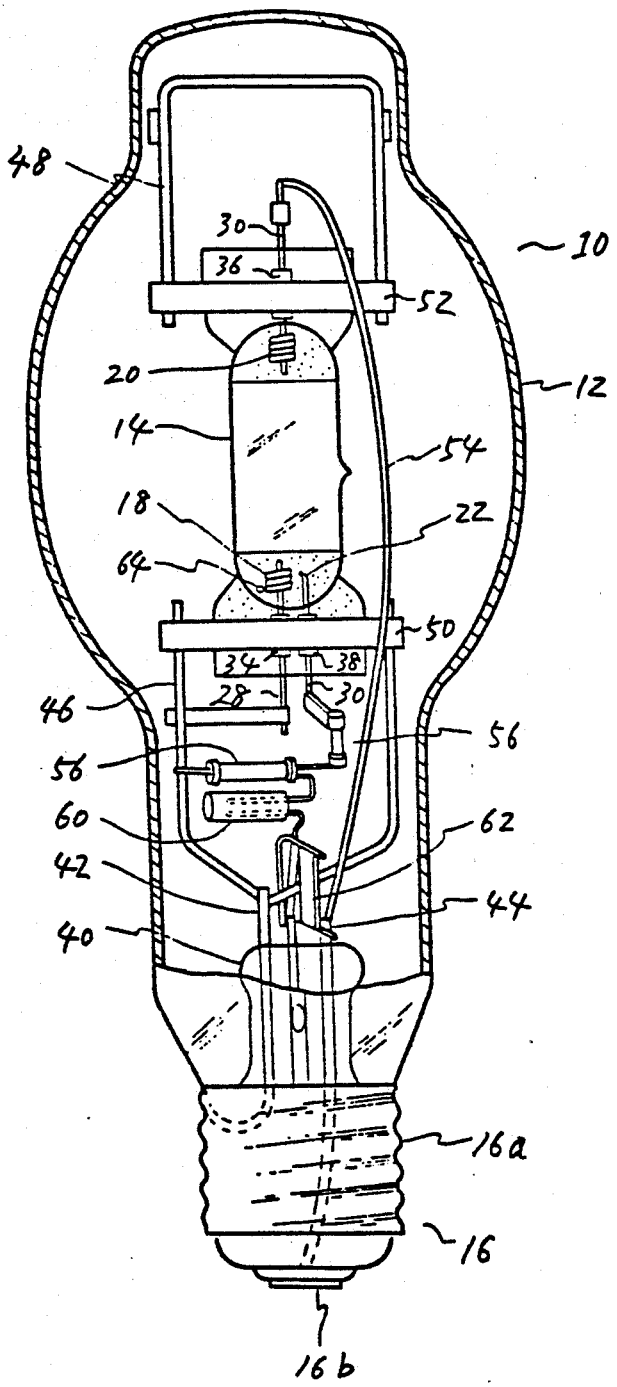
FIG. 1 is a longitudinal elevational view, partly in cross-section of a metal vapor discharge lamp according to the present invention.

The present invention will be described in detail with reference to the drawings, i.e., FIGS. 1 and 2. Throughout the drawings, like reference numerals or letters will be used to designate identical or corresponding parts and elements for simplicity of explanation.

Referring now to FIG. 1 an embodiment of the metal vapor discharge lamp according to the present invention will be described in detail. In FIG. 1, a metal vapor discharge lamp 10 comprises an outer bulb 12 and a discharge tube 14 made of quartz glass, which is suspended in outer bulb 12, as described later. Outer bulb 12 has a screw base 16 for coupling to a lamp holder (not shown) at its one end. Discharge tube 14 contains mercury (Hg), sodium iodide (NaI) and scandium iodide ($Sc_2I_3$). The mercury (Hg) is substantially completely vaporized and exerts a pressure of from 1 to 10 atmospheres during the operation of the lamp. An inert gas, for instance, krypton (Kr) at a pressure of 50 Torr, is included in discharge tube 14 to facilitate starting and warm-up. Discharge tube 14 is provided with a pair of main electrodes 18, 20 and a starting electrode 22, which are made of tungsten. Main electrodes 18, 20 are mounted at opposite ends of discharge tube 14 and starting electrode 22 is mounted near main electrode 18. Main electrodes 18, 20 each have a helix end, while starting electrode 22 has a straight end. The base of the main electrodes 18, 20 and starting electrode 22 are supported by pinch sealed ends 24, 26 of discharge tube 14, respectively. Main electrodes 18, 20 and starting electrode 22 are electrically connected to leads 28, 30 and 32 through thin molybdenum foils 34, 36 and 38, of which parts are embedded in pinch sealed ends 24, 26, respectively.

A neck portion 12*a* of outer bulb 12 near screw base 16 is sealed by a stem 40 through which stiff lead wires 42, 44 extend. The outer ends of stiff lead wires 42, 44 are selectively connected to the screw shell 16*a* and to the outer contact 16*b* of screw base 16.

Pinch sealed ends 24, 26 of discharge tube 14 are fixed to support structures 46, 48 by way of metal holders 50, 52. Support structure 46 is connected to stiff lead wire 42 by welding. Main electrode 18 is electrically connected to support structure 46 through lead wire 28. Main electrode 20 is connected to stiff lead wire 44 by way of a lead wire 54. Starting electrode 22 is connected to lead wire 46 through a series circuit of a starting resistor 56 and a current limiting resistor 58. Further, a series circuit of a glow starter 60 and a bimetal switch 62 are connected between support structure 46 and stiff lead wire 44 through current limiting resistor 58. Bimetal switch 62 is adapted to close at a prescribed low temperature and to open above a predetermined high temperature.

A radiation source 64 is sealed in discharge tube 14. As shown in FIG. 2, radiation source 64 comprises a container 66 and radioactive materials 68. Container 66 is made of ceramic material, e.g., aluminum oxide ($Al_2O_3$), silicon oxide ($SiO_2$) or the like. Radioactive material 68 is dispersed in container 66. Radiation source 64 has a vitreous shell 64a at least in its outer layer. Vitreous shell 64a is formed by heating radiation source 64 for approximately 2 hours at a temperature of about 1,300° C. in an inert gas or in vacuum. As a result, at least the ceramic material in the outer layer of radiation source 64 is vitrified.

Vitreous shell 64*a* is formed by vitrifying so that vitreous shell 64*a* has a mechanical strength the same as the protection glass shell, as described above in relation to the prior art, i.e., the U.S. Pat. No. 4,445,067. However, the vitrified ceramic material in vitreous shell 64a itself comprises radioactive mterial 68. Therefore, radiation source 64 may emit rays in sufficient amounts to reduce the starting time of the lamp.

Figure 2:
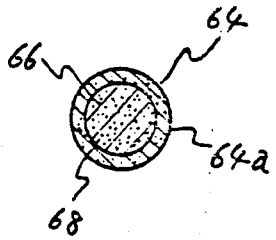
FIG. 2 is a schematic illustration of a radioactive source according to the present invention.

Radiation source 64 can be made freely into a desired size, or shape, as shown in FIGS. 1 and 2. For example, radiation source 64 is made smaller than the diameter of an exhaust tube (not shown) which is provided to discharge tube 14 for exhausting air in discharge tube 14. Then radiation source 64 is put in discharge tube 14 through the exhaust tube before exhausting the air in discharge tube 14. The exhaust tube is removed after exhausting the air.

Container 66 should be mechanically hard and stable when it is vitrified. Thus, the material for container 66 can be selected from non-metal oxides, such as silicon oxide ($SiO_2$), metal oxides such as aluminum oxide ($Al_2O_3$), sodium oxide ($Na_2O$), magnesium oxide (MgO), beryllium oxide (BeO), titanium oxide (TiO) or calcium oxide (CaO), metal carbides, such as aluminum carbide ($Al_4C_3$), sodium carbide ($Na_2C_2$) or calcium carbide ($CaC_2$) and metal nitrides, such as aluminum nitride (AlN), sodium nitride ($Na_3N$), magnesium nitride ($Mg_3N_2$). For example, one or more of the materials may be used alone or together for forming container 66.

Radioactive material 68 should have a relatively short half-life, e.g., a half-life of more than 0.5 years and less than $10^4$ years. Thus, radioactive material 68 can be selected from carbon 14 ($^{14}C$), sodium 22 ($^{22}Na$), calcium 45 ($^{45}Ca$), iron 55 ($^{55}Fe$), cobalt 60 ($^{60}Co$), nickel 63 ($^{63}Ni$), zinc 65 ($^{65}Zn$), manganese 54 ($^{54}Mn$), strontium 90 ($^{90}Sr$), ruthenium 106 ($^{106}Ru$), silver 110 ($^{110}Ag$), antimony 125 ($^{125}Sb$), cesium 134 ($^{134}Cs$), cesium 137 ($^{137}Cs$), barium 133 ($^{133}Ba$), cerium 144 ($^{144}Cs$), promethium 147 ($^{147}Pm$), europium 154 ($^{154}Eu$), europium 155 ($^{155}Eu$), gold 195 ($^{195}Au$), thallium 204 ($^{204}Tl$), actinium 227 ($^{227}AC$), americium 241 ($^{241}Am$), curium 242 ($^{242}Cm$), curium 244 ($^{244}Cm$), radium 226 ($^{226}Ra$), radium 228 ($^{228}Ra$) or thorium 228 ($^{228}Th$), which are all possible candidates. Also, one or more of these radioactive materials may be used alone or together is radioactive material 68.

Further, the amount of radioactive material 68 is limited so that radioactive material 68 emits rays of less than 100 μCi (micro curie) per lamp.

Radiation source 64 can be made as follows. Ceramic materials such as aluminum oxide ($Al_2O_3$), silicon oxide ($SiO_2$) and sodium oxide ($Na_2O_3$) are mixed at a predetermined ratio and heated so that a ceramic sinter consisting of $xAl_2O_3.ySiO_2.zNa_2O_3$ is obtained. In this expression, x, y and z refer respectively to the molar ratio. Then, sodium (Na) atoms of the ceramic sinter $xAl_2O_3.ySiO_2.zNa_2O_3$ are replaced with promethium 147 ($^{147}Pm$) atoms by a well known method, e.g., an ion change method. For example, the ceramic sinter $xAl_2O_3.ySiO_2.zNa_2O_3$ may be changed to $xAl_2O_3.ySiO_2.z(Nh_4)_2O_3$ by steeping in a liquid of ammonium chloride ($NH_4C1$). Next by a treatment of removing ammonium ($NH_4$) from the ceramic body $xAl_2O_3.ySiO_2.z(NH_4)_2O$ it is changed to $xAl_2O_3.ySiO_2.zH_2O$ by heating at a temperature of about 300° C. Next the ceramic body consisting of $xAl_2O_3.ySiO_2.zH_2O$ is reduced to $xAl_2O_3.ySiO_2.zHPmO$ by replacing hydrogen (H) of $xAl_2O_3.ySiO_2.zH_2O$ with promethium 147 ($^{147}Pm$) of about 0.1 μCi by soaking the ceramic body $xAl_2O_3.ySiO_2.zH_2O$ in a solution of promethium 147 chloride hydrochloride. The half-life of promethium 147 is about 2.7 years. Finally, by heating the ceramic body consisting of $xAl_2O_3.ySiO_2.zHPmO$ at a temperature of about 1,300° C. for about 2 hours in vacuum, at least the outer layer of the ceramic body is vitrified. As a result, a desired radioactive source 64, comprising container 66 and radioactive material 68 therein, is obtained.

Radiation source 64 manufactured by the above mentioned method is safe to the human body because radioactive material 68 is impregnated into the ceramic body, consisting of aluminum oxide ($Al_2O_3$) and silicon oxide ($SiO_2$). The safety of radiation source 64 to the human body is proven by the well known smear test.

Another method of making radiation source 64 is possible. In this method, a powder of ceramic materials, such as aluminum oxide ($Al_2O_3$), silicon oxide ($SiO_2$) and sodium oxide ($Na_2O_3$), are mixed uniformly with a very small quantity of powder of radioactive material 68. Next, the mixed powder is heated in an inert gas or in a vacuum so that the mixture is sintered. By heating the sintered mixture further at least until its outer layer is vitrified, a desired radiation source 64 is obtained as at least its outer layer is impregnated with radioactive material 68.

If container 66 is oxide, the oxide is made into a paste by mixing an organic solder, such as butyl acetate, with a powder of radioactive material 68. After forming into a pellet by compressing the mixture, the mixture is heated in an inert gas or in a vacuum, so that the mixture is sintered. By heating the sintered mixture further at least until its outer layer is vitrified, a desired radiation source 64 is obtained, as at least its outer layer is impregnated with radioactive material 68.

If container 66 is halide, the halide and radioactive material 68 are mixed and heated in an inert gas or in a vacuum, so that the mixture is sintered. By continuously heating the sintered mixture at least until its outer layer is vitrified, a desired radiation source 64, is obtained as at least its outer layer is impregnated with radioactive material 68.

In such a metal vapor discharge lamp 1O, when metal vapor discharge lamp 10 is turned ON and a voltage is supplied from a power source to metal vapor discharge lamp 10, a current flows between support structure 46 and stiff lead wire 44 through current limiting resistor 58, glow starter 60 and bimetal switch 62. Glow starter 60 then begins to operate because of the current flowing through bimetal switch 62. The operation of glow starter 60 generates a pulse voltage. The pulse voltage causes a glow discharge between main electrode 18 and starting electrode 22 in discharge tube 14, whereby the pulse voltage is superimposed on the secondary voltage of the stabilizer, which is coupled between metal vapor discharge lamp 10 and the power source, as described before. A resultant high voltage is impressed across main electrode 18 and main electrode 20. Radiation source 64, at this time, is releasing rays. The rays ionize the metal vapor in discharge tube 14 so that many electrons are generated in discharge tube 14 due to the ionization. Therefore, an arc discharge is easily initiated between main electrodes 18 and 20 by the electrons and the pulse voltage. In other words, the rays radiated from radiation source 64 are used as seeds for initiating the arc discharge. Once the arc discharge occurs, glow starter 60 no longer operates, so that the pulse voltage ceases.

In such a metal vapor discharge lamp 10, when metal vapor discharge lamp 10 is turned ON, a voltage is applied to metal vapor discharge lamp 1O from the power source through the stabilizer coupled between metal vapor discharge lamp 10 and the power source, as described before. The voltage is applied to glow starter 60 through current limiting resistor 58 and bimetal switch 62. Glow starter 60 has a bimetal switch therein, as is well known. The bimetal switch in glow starter 60 is open before the voltage is applied thereto. Therefore, a glow discharge occurs in glow starter 60 when the voltage is applied thereto, since the bimetal switch of glow starter 60 is open. The bimetal switch in glow starter 60 is then heated by the glow discharge, so that it closes due to the heat. During the closed state of the bimetal switch, it is cooled. Then, the bimetal switch is again opened. The opening operation of the bimetal switch of glow starter 60 generates a pulse voltage.

The pulse voltage generated by glow srarter 60 is superimposed on the secondary voltage of the stabilizer, which is coupled between metal vapor discharge lamp 10 and the power source, as described before. A resultant high voltage is impressed across main electrode 18 and starting electrode 22 through bimetal switch 62, glow starter 60 and starting resistor 56. This is because bimetal switch 62 is closed in the initial state of metal vapor discharge lamp 10. Then, a glow discharge occurs between main electrode 18 and starting electrode 22 according to the high pulse voltage. This glow discharge between main electrode 18 and starting electrode 22 progresses to an arc discharge between main electrode 18 and main electrode 20. This is because the high voltage is also applied between main electrode 18 and main electrode 20. As a result, the lighting operating of metal vapor discharge lamp 10 starts.

After the lighting of metal vapor discharge lamp 10 has started, evaporation of the mercury or the metal halides in discharge tube 14 is accelerated and the temperature in metal vapor discharge lamp 10 rises. Bimetal switch 62 is turned OFF in response to the temperature rise. In other words, when the lighting operation of metal vapor discharge lamp 1O reaches a stable state, bimetal switch 62 is turned OFF. After bimetal switch 62 has been turned OFF, the voltage is not applied to glow starter 60. Starting electrode 22 is maintained at the same potential as main electrode 18, due to the circuit of starting resisitor 56 and current limiting resistor 58. As a result, ionization of the quartz glass between main electrode 18 and starting electrode 22 is prevented. Such ionization causes damage to the quartz glass, such as crystalization or cracking of the quartz glass.

Metal vapor discharge lamp 1O has radiation source 64 in discharge tube 14. Radiation source 64 emits rays which operate as a seed for causing the glow discharge and/or the arc discharge, as described above. The starting of metal vapor discharge lamp 1O then is carried out quickly. Also, the starting voltage required for metal vapor discharge lamp 10 may be decreased. This is because the inert gas in discharge tube 14 is ionized by the rays emitted from radioactive material 68 in radiation source 64. If a high pulse voltage is applied when the inert gas has been ionized, a puncture of the inert gas occurs between the electrodes. As a result, the glow and/or arc discharge starts.

When radiation source 64 is not be used, the ionization of the inert gas is carried out only by the natural rays, such as the cosmic rays or the rays emitted from the earth. However, the natural rays are very weak. The occurence of the natural rays is at a rate of approximately one per every 20 seconds. Therefore, the starting period of the conventional lamps is longer than the lamp according to the present invention.

Radioactive material 68 is dispersely contained in radiation source 64. Further, the outer layer of radiation source 64 is vitrious. In other words, the outer layer itself is vitrified as it is impregnated with radioactive material 68. The outer layer of radiation source 64 is mechanically hard and stable. Therefore, there is neither a fear of radioactive material 68 being peeled off from radiation source 64 during handling thereof nor a danger that radioactive material 68 may contact a human body.

Radioactive material 68 is also contained in the outer layer of radiation source 64, so that rays such as alpha rays ($\alpha$rays), beta rays ($\beta$rays), gamma rays ($\gamma$rays), etc. radiated from radioactive material 68 are not reduced in their transmissivity in the vitrious outer layer of radiation source 64. Thus, a sufficient amount of rays is obtained for starting the lamp quickly.

According to the present invention, at least its outer layer of the radiation source is hardened as the layer itself is impregnated with the radioactive substance. Therefore, the radiation source can emit a sufficient amount of rays for quick starting of the lamp. Handling of the radiation source does not pose any significant danger for the human body. Further, the radiation source can be easily manufactured, since the ceramic material of the radioactive material, i.e., the container of the radioactive material, is vitrified simply by heating. That is, the vitrification of the ceramic material can be carried out in succession to the formation of the ceramic body. It is easy to make the vitrious layer uniform in thickness.

Therefore, the present invention can provide a metal vapor discharge lamp with excellent starting characteristics.

While there has been illustrated and described what are at present considered to be preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teaching of the present invention without departing from the central scope thereof. Therefore, it is intended that this invention not be limited to the particular embodiment disclosed as the best mode contemplated for carrying out this invention, but that the invention includes all embodiments falling within the scope of the appended claims.

What is claimed is:

1. A vapor discharge lamp comprising:

an enclosed discharge tube having a pair of main electrodes mounted at spaced apart locations therein, the discharge tube including a fill of at least a metal vapor and a starting gas;

a radiation source including radioactively impregnated ceramic material having an outer protection portion comprising a vitrified radioactive material; said radiation source being located within said discharge tube;

an outer bulb for enclosing the discharge tube;

and a circuit for electrically generating an arc between the main electrodes.

2. The lamp of claim 1, wherein the radiation source has a half-life of less than $1\times10^4$ years.

3. The lamp of claim 2, wherein the radiation source includes a ceramic body having radioactive material dispersed therein.

4. The lamp of claim 3, wherein the outer protection portion includes a mechanically hard vitreous layer for protecting the radiation source against defacement.

5. The lamp of claim 3, wherein the radioactive material includes at least one selected from carbon 14 ($^{14}C$), sodium 22 ($^{22}Na$), calcium 45 ($^{45}Ca$), iron 55 ($^{55}Fe$), cobalt 60 ($^{60}CO$), nickel 63 ($^{63}Ni$), zinc 65 ($^{65}Zn$), manganese 54 ($^{54}Mn$), strontium 90 ($^{90}Sr$), ruthenium 106 ($^{106}Ru$), silver 110 ($^{11O}Ag$), antimony 125 ($^{125}Sb$), cesium 134 ($^{134}Cs$), cesium 137 ($^{137}Cs$), barium 133 ($^{133}Ba$), cerium 144 ($^{144}Ce$), promethium 147 ($^{147}Pm$), europium 154 ($^{154}Eu$), europium 155 ($^{135}Eu$), gold 195 (195Au), thallium 204 ($^{204}Tl$), actinium 227 ($^{227}AC$), americium 241 ($^{241}AM$), curium 242 ($^{242}Cm$), curium 244 ($^{244}CM$), radium 226 (226Ra), radium 228 (228Ra) and thorium 228 ($^{228}Th$).

6. The method for making a radiation source for a metal vapor discharge lamp, comprising the steps of:

mixing ceramic materials to form a ceramic body;

impregnating the cermaic body with radioactive material; and vitrifying at least the outer portion of the ceramic body to yield an outer protection portion comprising a vitrified radioactive material.

7. The method of claim 6 wherein the step of vitrifying includes the step of heating the ceramic body to about 1,300° C. for about 2 hours.

8. The method of claim 7 wherein the step of heating includes the step of disposing the ceramic body in one of an inert gas and a vacuum.

9. The method of claim 8 wherein the step of impregnating includes the step of selecting a radioactive material having a half-life of less than $1\times10^4$ years, and dispersing the radioactive material in the ceramic body.

10. The method for making a radiation source for a metal vapor discharge lamp, comprising the steps of:

mixing powders of ceramic material and material; and heating the mixture to about 1,300° C. for about 2 hours to yield an outer protection portion comprising a vitrified radioactive material.

11. The method of claim 10 wherein the step of heating includes the step of disposing the ceramic material in one of an inert gas and a vacuum.

12. The method of claim 11 wherein the step of heating includes the steps of sintering the mixture and vitrifying at least the outer portion of the sintered mixture.

13. The lamp of claim 1, wherein the radiation source includes a ceramic body having radioactive material dispersed therein, and the amount of radioactive material is limited so that it emits rays of less than 100 $\mu$Ci per lamp.

14. The method of claim 6, wherein the amount of radioactive material is limited so that it emits rays of less than 100 $\mu$Ci per lamp.

15. The method of claim 10, wherein the amount of radioactive material is limited so that it emits rays of less than 100 $\mu$Ci per lamp.

* * * * *